US007131504B2

(12) United States Patent
Odell, II et al.

(10) Patent No.: US 7,131,504 B2
(45) **Date of Patent: *Nov. 7, 2006**

(54) PRESSURE ACTIVATED RELEASE MEMBER FOR AN EXPANDABLE DRILLBIT

(75) Inventors: Albert C. Odell, II, Kingwood, TX (US); Andrew D. Gledhill, Stonehaven (GB); Michael Tague Smalley, Singapore (SG); Mark S. Fuller, Montgomery, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 32 days.

This patent is subject to a terminal disclaimer.

(21) Appl. No.: 10/935,485

(22) Filed: Sep. 7, 2004

(65) Prior Publication Data

US 2006/0048972 A1 Mar. 9, 2006

Related U.S. Application Data

(63) Continuation-in-part of application No. 10/335,957, filed on Dec. 31, 2002, now Pat. No. 6,953,096.

(51) Int. Cl.
*E21B 7/28* (2006.01)

(52) U.S. Cl. ..... 175/57; 175/269

(58) Field of Classification Search ..... 175/267, 175/269, 271

See application file for complete search history.

(56) References Cited

U.S. PATENT DOCUMENTS 3,406,769 A * 10/1968 Kammerer, Jr. ..... 175/269
4,081,042 A 3/1978 Johnson et al.
4,565,252 A 1/1986 Campbell et al.
5,141,063 A 8/1992 Quesenbury
6,009,961 A 1/2000 Pietrobelli et al.
6,131,675 A 10/2000 Anderson
6,360,831 B1 3/2002 Akesson et al.
6,886,633 B1 5/2005 Fanuel et al.
6,920,944 B1 7/2005 Eppink et al.
6,953,096 B1 * 10/2005 Gledhill et al. ..... 175/57
2003/0183424 A1 10/2003 Tulloch
2004/0124011 A1 7/2004 Gledhill et al.
2004/0211597 A1 10/2004 Cravatte (Continued)

FOREIGN PATENT DOCUMENTS

CA 2 454 496 6/2004

(Continued)

OTHER PUBLICATIONS

U.K. Search Report, Application No. GB0518163.1, dated Oct. 19, 2005.

*Primary Examiner*—Frank S. Tsay
(74) *Attorney, Agent, or Firm*—Patterson & Sheridan, LLP

(57) ABSTRACT

An apparatus for use in a wellbore. The apparatus includes a body and a blade assembly. The blade assembly is movable between a collapsed position whereby the expandable apparatus has a smaller outer diameter and an expanded position whereby the expandable apparatus has a larger outer diameter. The apparatus further includes a pressure activated member for selectively allowing the blade assembly to move from the closed position to the open position. A method for using the apparatus, wherein a drill string with an expandable bit at the end thereof is lowered into the wellbore. Thereafter, the pressure activated member is activated to allow the cutting members to move from the collapsed position to the expanded position. Subsequently, the expandable bit is rotated to form a portion of the wellbore. Next, the expandable bit is deactivated and the cutting members are moved from the expanded position to the collapsed position.

21 Claims, 4 Drawing Sheets

U.S. PATENT DOCUMENTS

2004/0261998 A1* 12/2004 Lavaure et al. ..... 166/285

FOREIGN PATENT DOCUMENTS

| | | |
|---|---|---|
| EP | 1 528 221 | 5/2005 |
| GB | 2 275 067 | 8/1994 |
| GB | 2 294 715 | 5/1996 |
| GB | 2 320 270 | 6/1998 |
| GB | 2 352 747 | 2/2001 |
| GB | 2 396 871 | 7/2004 |
| WO | WO 01/81708 | 11/2001 |

* cited by examiner

PRESSURE ACTIVATED RELEASE MEMBER FOR AN EXPANDABLE DRILLBIT

CROSS-REFERENCE TO RELATED APPLICATIONS

This application is a continuation-in-part of U.S. patent application Ser. No. 10/335,957, filed on Dec. 31, 2002, now U.S. Pat. No. 6,953,096, which application is herein incorporated by reference in its entirety.

BACKGROUND OF THE INVENTION

1. Field of the Invention

The present invention generally relates to wellbore completion. More particularly, the invention relates to downhole tools. More particularly still, the invention relates to an expandable bit with a pressure activated release member.

2. Description of the Related Art

In the drilling of oil and gas wells, a wellbore is formed using a drill bit that is urged downwardly at a lower end of a drill string. The drill bit generally includes a body portion for securing the drill bit to the drill string and a crown portion to form the wellbore. After drilling a predetermined depth, the drill string and the drill bit are removed, and the wellbore is lined with a string of steel pipe called casing. The casing typically includes a smaller outside diameter than the drill bit that formed the wellbore. The casing provides support to the wellbore and facilitates the isolation of certain areas of the wellbore adjacent hydrocarbon bearing formations. The casing typically extends down the wellbore from the surface of the well to a designated depth. An annular area is thus defined between the outside of the casing and the earth formation. This annular area is typically filled with cement to permanently set the casing in the wellbore and to facilitate the isolation of production zones and fluids at different depths within the wellbore.

In a conventional completion operation, it is common to employ more than one string of casing in a wellbore. In this respect, the well is drilled to a second designated depth of a smaller diameter, and a second string of casing, or liner, is run into the drilled out portion of the wellbore. The second string is set at a depth such that the upper portion of the second string of casing overlaps the lower portion of the first string of casing and then cemented in place. This process is typically repeated with additional casing strings until the well has been drilled to a total depth.

The process of cementing a liner into a wellbore typically involves the use of wiper plugs and drill-pipe darts. Plugs typically define an elongated elastomeric body used to separate fluids pumped into a wellbore. A liner wiper plug is typically located inside the top of a liner, and is lowered into the wellbore with the liner at the bottom of a working string. The liner wiper plug has radial wipers to contact and wipe the inside of the liner as the plug travels down the liner. The liner wiper plug has a cylindrical bore through it to allow passage of fluids.

Typically, the cementing operation requires the use of two plugs and two darts. When the cement is ready to be dispensed, a first dart is released into the working string. The cement is pumped behind the dart, thereby moving the first dart downhole. The first dart acts as a barrier between the cement and the drilling fluid to minimize the contamination of the cement. As the first dart travels downhole, it seats against a first liner wiper plug and closes off the internal bore through the first plug. Hydraulic pressure from the cement above the first dart dislodges the first dart and the first plug from the liner and pumped down the liner together. At the bottom of the liner, the first plug seats against a float collar, thereby closing off fluid flow through the float collar. The pressure builds above the first plug until it is sufficient to cause a membrane in the first plug to rupture. Thereafter, cement flows through the first plug, the float collar, a shoe track, and a float shoe and subsequently into the annular space between the liner and the wellbore.

Generally, the shoe track is a space defined between the float collar and the float shoe. The shoe track is used to ensure that the float shoe is surrounded in high quality cement and that any contamination or lower quality cement that may bypass a second liner wiper plug is safely contained within the shoe track.

After a sufficient volume of cement has been placed into the wellbore, a second dart is deployed. Drilling mud is pumped in behind the second dart to move the second dart down the working string into the liner. The second dart travels downhole and seats against a second liner wiper plug. Thereafter, hydraulic pressure above the second dart dislodges the second dart and the second plug from the liner and they are pumped together down the liner. In turn, cement ahead of the second plug is displaced through the shoe track and subsequently out of the liner into the annulus. After the cementing operation is complete, the shoe track is typically drilled out as the well is drilled to another designated depth.

From time to time and for a variety of reasons it is necessary to form a portion of a wellbore that is at least as large as the section of the cased wellbore thereabove. For example, a monobore well consists of a sequence of expandable liners that are run through the existing casing, then expanded to achieve the same post-expansion through-bore. In forming the monobore well, the portion of the wellbore below the cased portion must be at least as large as the section of the cased wellbore thereabove.

There are a variety of different methods of forming an enlarged wellbore. One such method is by positioning a conventional under-reamer behind a drill bit to cut the enlarged wellbore. In this drilling configuration, the drill bit acts as a pilot bit to cut the inner cross-sectional area while the under-reamer enlarges the cross-sectional area. Generally, the conventional under-reamer includes a number of expandable arms that move between a closed position and an open position. The ability of the conventional under-reamer to open and close the arms allows the under-reamer in the closed position and the pilot bit to travel though a smaller diameter casing. After passing through the casing and the shoe track the under-reamer may be opened to form an enlarged diameter bore below the casing shoe resulting in a wellbore equal to or larger than the original drilled hole. Thereafter, the enlarged wellbore may be lined with expandable liners. This procedure of forming the enlarged borehole, although effective may be time consuming and expensive.

In recent years bi-center bits have been developed as an alternative to the conventional under-reamer. Generally, the bi-center bit includes offset cutting members mounted at irregular intervals around the crown of the bit. As the bi-center bit is rotated, the offset cutting members rotate to form an enlarged wellbore. Although, this method of forming an enlarged wellbore is becoming more common the bi-center bits are unstable due to their irregular structure and tend to be more difficult to control for directional purposes than ordinary drill bits. Additionally, the bi-center bits may not drill the expected swept diameter of the offset pads which ream the pilot hole created by the crown.

More recently, an expandable bit has been used to form an enlarged portion of the wellbore. The expandable bit was introduced to overcome the deficiencies in the conventional under-reamer and the bi-center bit. An example of an expandable bit is disclosed in International Publication Number WO 01/81708 A1, which is incorporated herein in its entirety. Similar to the conventional under-reamer, the expandable bit includes a set of blades that move between an open position and a closed position. Generally, in operation hydraulic fluid is pumped through the center of the expandable bit to move the blades between the open and the closed position. A more detailed discussion of the expandable bit will be described in subsequent paragraphs.

Even though the expandable bit overcomes many of the deficiencies in the conventional under-reamer and the bi-center bit, a problem still exists with the use of the expandable bit to drill out the shoetrack. The problem occurs when the blades in the expandable bit inadvertently move from the closed position to the open position and contact the ID of the casing while drilling out the shoetrack, thereby resulting in an increase of torque and damage to the blades.

In view of the deficiency of the expandable drill bit, a need therefore exists for an expandable bit with a pressure activated release member to selectively allow the blades to move from the closed position to the open position. There is a further need for an improved expandable bit.

SUMMARY OF THE INVENTION

The present invention generally relates to an apparatus and method of forming a wellbore. In one aspect, an expandable apparatus for use in a wellbore is provided. The apparatus includes a body and a blade assembly disposed on the body. The blade assembly is movable between a closed position whereby the expandable apparatus has a smaller outer diameter and an open position whereby the expandable apparatus has a larger outer diameter. The apparatus further includes a pressure activated member to selectively allow the blade assembly to move from the closed position to the open position.

In another aspect, a method of forming a wellbore is provided. The method includes lowering a drill string with an expandable bit at the end thereof into the wellbore. The expandable bit includes a body, cutting members, and a pressure activated member for allowing the cutting members to move from a collapsed position to an expanded position. The method further includes operating the pressure activated member and activating the expandable bit, thereby causing the cutting members to move from the collapsed position to the expanded position. The method also includes rotating the expandable bit to form a portion of the wellbore. Additionally, the method includes deactivating the expandable bit, thereby causing the cutting members to move from the expanded position to the collapsed position and removing the drill string and the expandable bit from the wellbore.

In yet another aspect, an expandable bit for use in a wellbore is provided. The expandable bit includes a body and at least one cutting member disposed on the body. The at least one cutting member is movable between a collapsed position and an expanded position. The expandable bit also includes a release member to selectively allow the at least one cutting member to move from the collapsed position to the expanded position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In general, the present invention relates to an expandable bit with a pressure activated member. The expandable bit includes a set of blades that move between an open position and a closed position through the use of hydraulic pressure. As will be described herein, the expandable bit is employed to drill through a shoe track and then subsequently employed to drill the wellbore to a designated depth. It must be noted that aspects of the present invention are not limited to drilling through the shoe track, but are equally applicable to other types of wellbore operations requiring the use of the expandable bit. Additionally, the present invention will be described as it relates to a vertical wellbore. However, it should be understood that the invention may be employed in a horizontal or deviated wellbore without departing from the principles of the present invention. To better understand the novelty of the apparatus of the present invention and the methods of use thereof, reference is hereafter made to the accompanying drawings.

Figure 1:
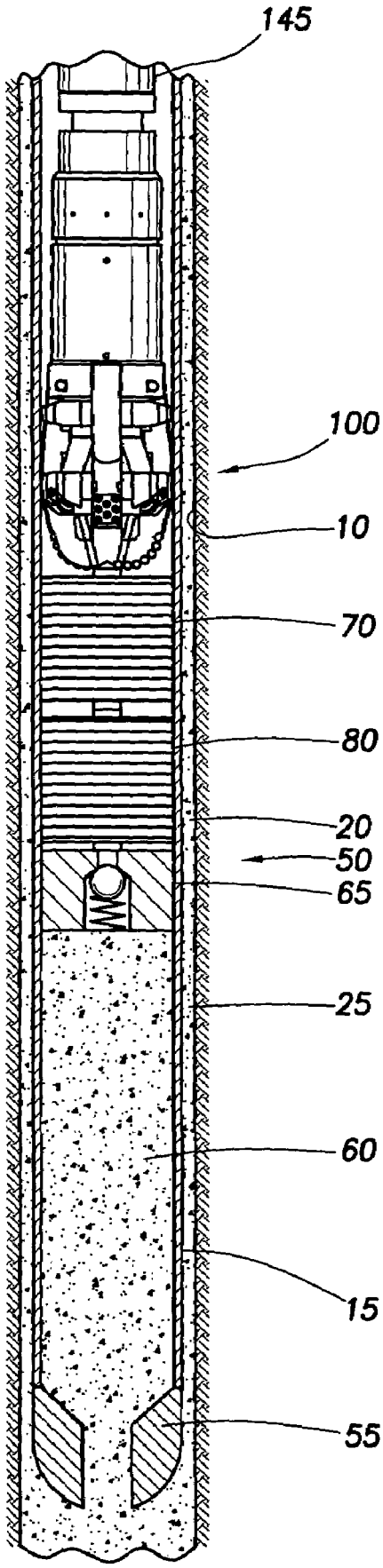
FIG. 1 is a sectional view illustrating an expandable bit being lowered into a wellbore after a cementing operation.

FIG. 1 is a sectional view illustrating an expandable bit 100 being lowered into a wellbore 10 at the lower end of a drill string 145 after a cementing operation. As illustrated, the wellbore 10 is lined with a string of steel pipe called casing 15. The casing 15 provides support to the wellbore 10 and facilitates the isolation of certain areas of the wellbore 10 adjacent hydrocarbon bearing formations. The casing 15 typically extends down the wellbore 10 from the surface of the well to a designated depth. An annular area 20 is thus defined between the outside of the casing 15 and the wellbore 10. This annular area 20 is filled with cement 25 pumped through a cementing system 50 to permanently set the casing 15 in the wellbore 10 and to facilitate the isolation of production zones and fluids at different depths within the wellbore 10.

The cementing system 50 generally includes a float shoe 55 disposed at the lower end thereof to prevent reverse flow, or U-tubing, of the cement 25 from the annulus 20 into the casing 15. The cementing system 50 also includes a shoe track 60 which is a space defined between the float shoe 55 and a float collar 65. The principal function of the shoe track 60 is to ensure that the float shoe 55 is surrounded in high-quality cement and that any contamination that may bypass cement plugs 70, 80 is safely contained within the shoe track 60.

Figure 2:
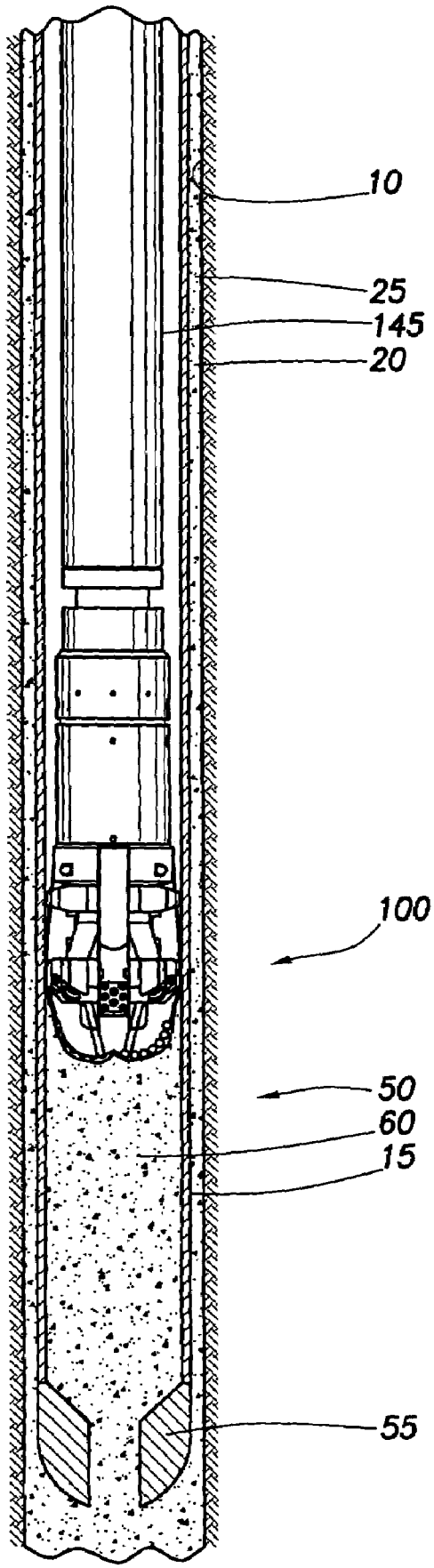
FIG. 2 is a sectional view illustrating a shoe track being drilled out by the expandable bit.

After the casing 15 is permanently set in the wellbore 10, the expandable bit 100 is employed to drill through the cementing system 50 and to subsequently drill the wellbore 10 to another designated depth. As illustrated in FIG. 2, the shoe track 60 is being drilled out by the expandable bit 100. During this operation, the expandable bit 100 remains in a closed position in order to prevent damage to a set of expandable blades. To this end, the expandable bit 100 is held in the closed position by a release member 200 as will be described herein.

Figure 3:
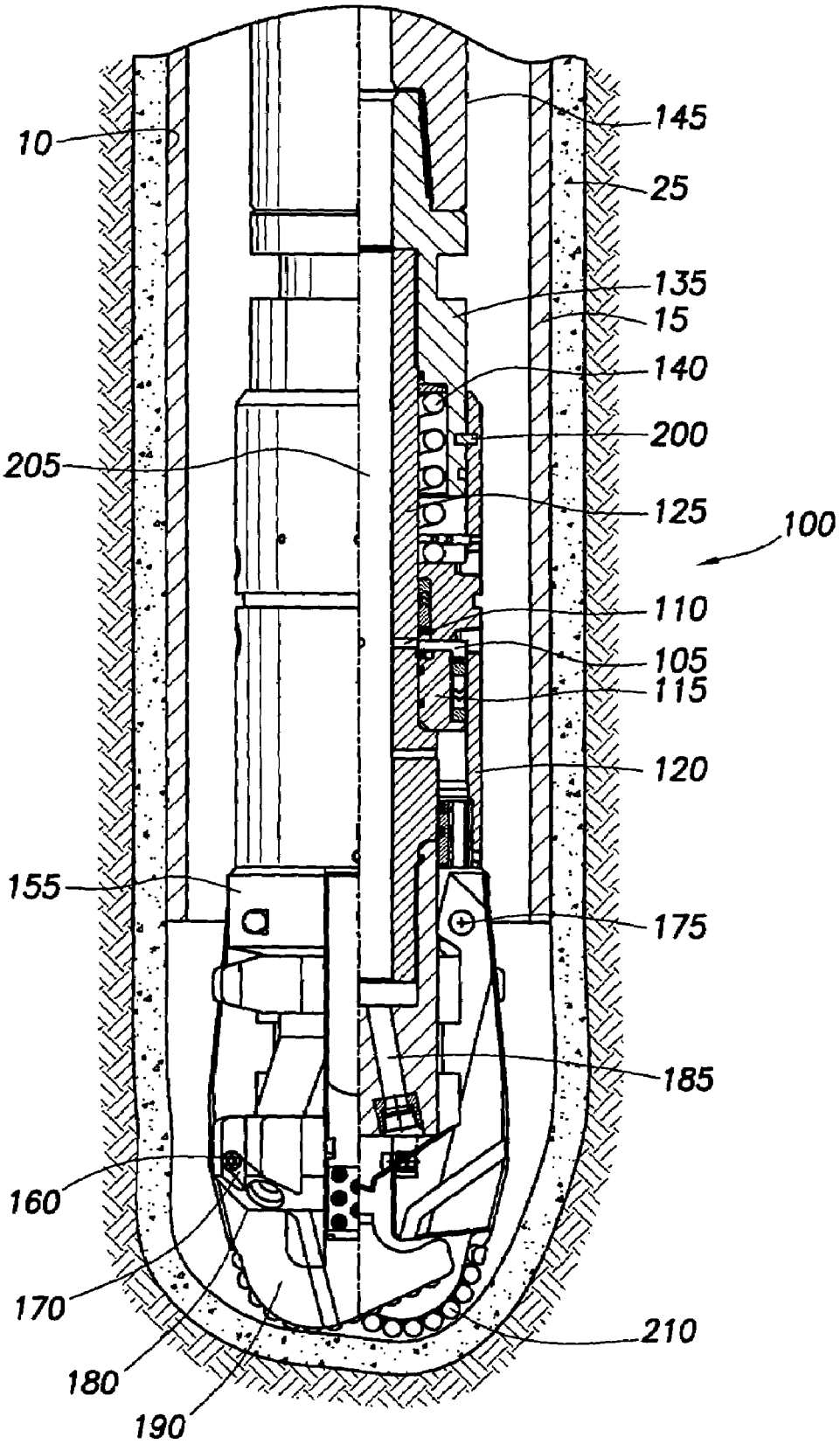
FIG. 3 is a sectional view illustrating the expandable bit positioned at a lower end of a casing string.

FIG. 3 is a sectional view illustrating the expandable bit 100 positioned at a lower end of the casing 15. Generally, the expandable bit 100 may move between an open position and a closed position. In the open position, (FIG. 4) arms 190 at the lower end of the expandable bit 100 are expanded outward while in the closed position the arms 190 are collapsed inward. The arms 190 are attached to a blade pivot housing 155 by a plurality of hinge pins 175. The hinge pins 175 allow the arms 190 to swing out from a body 125 of the bit 100. The arms 190 include a plurality of cutting elements 210 made of a hard material such as tungsten carbide or polycrystalline diamond. The arms 190 are constructed and arranged to permit the cutting elements 210 to contact and drill the earth when the arms 190 are expanded outward and not ream the wellbore or surrounding casing 135 when the arms 190 are collapsed inward. Each arm 190 may carry a single or double row of cutting elements 210 depending on the desired drilling configuration.

As shown in FIG. 3, nozzles 185 are arranged at the lower end of the body 125. The nozzles 185 are in fluid communication with a bore 205 defined in the body 125 to communicate fluid through the expandable bit 100 and allow jetting of the drilling fluid during the drilling operation to remove any cutting build up that may gather in front of the arms 190. The nozzles 185 are also used to create a hydraulic pressure differential within the bore 205 of the expandable bit 100 in order to cause the arms 190 to expand outward as will be discussed herein.

As briefly discussed above, the expandable bit 100 includes the release member 200 to ensure that the arms 190 remain in the collapsed position during the drilling operation of the shoe track. Generally, the release member 200 is a device that operates at a predetermined pressure or force. In one embodiment, the release member 200 is a shear pin disposed between a hydraulic cylinder 120 and a housing 135 as illustrated in FIG. 3. The shear pin is constructed and arranged to fail at a predetermined axial force. Generally, the shear pin is a short piece of brass or steel that is used to retain sliding components in a fixed position until sufficient force is applied to break the pin. Once the pin is sheared, the components may then move to operate or function the tool.

Alternatively, other forms of shearable members may be employed in the release member 200, as long as they are capable of shearing at a predetermined force. For example, a threaded connection (not shown) may be employed between the hydraulic cylinder 120 and the housing 135. Generally, the threads machined on the hydraulic cylinder 120 are mated with threads machined on the housing 135 to form the threaded connection. The threads on the hydraulic cylinder 120 and the housing 135 are machined to a close fit tolerance. The threads are constructed and arranged to fail or shear when a predetermined axial force is applied to the hydraulic cylinder 120. The desired axial force required to actuate the release member 200 determines the quantity of threads and the thread pitch. In another example, a collet assembly (not shown) may be employed between the hydraulic cylinder 120 and the housing 135. The collet assembly is constructed and arranged to fail when a predetermined axial force is applied to the hydraulic cylinder 120.

As shown in FIG. 3, the release member 200 is disposed between the hydraulic cylinder 120 and the housing 135. It should be understood, however, that the release member 200 may be disposed at any location along the hydraulic cylinder 120, without departing from the principles of the present invention. For instance, the release member 200 may be disposed between the hydraulic cylinder 120 and the blade pivot housing 155.

After the expandable bit 100 is positioned at a desired location in the wellbore 10, the release member 200 is actuated by pumping fluid from the surface of the wellbore 10 through the expandable bit 100. Generally, as fluid is pumped through the expandable bit 100, the nozzles 185 restrict the fluid flow causing a hydraulic pressure differential and urging a portion of fluid through a port 110 formed in the body 125 to fill a chamber 105 defined between the hydraulic cylinder 120 and an internal piston 115. As the chamber 105 fills with fluid, the hydraulic cylinder 120 is urged axially upward creating a force on the pressure release member 200. At a predetermined force, the release member 200 fails, thereby allowing the hydraulic cylinder 120 to move in relation to the housing 135. As the chamber 105 fills with additional fluid, the volume of the chamber 105 increases, causing the hydraulic cylinder 120 to move axially upward compressing a biasing member 140. At the same time, the hydraulic cylinder 120 draws the blade pivot housing 155 axially upward, thereby pulling the arms 190 over the head 180. In this manner, the axial force created on the blade pivot housing 155 by the hydraulic cylinder 120 causes the arms 190 to pivot outwards at pins 175 to the expanded position and to remain in the expanded position as long as the hydraulic pressure differential is maintained in the body 125 of the expandable bit 100. Additionally, guide pins 160 act on slots 170 machined in the arms 190 to ensure that the arms 190 return to the closed position upon removal of the hydraulic pressure differential.

Figure 4:
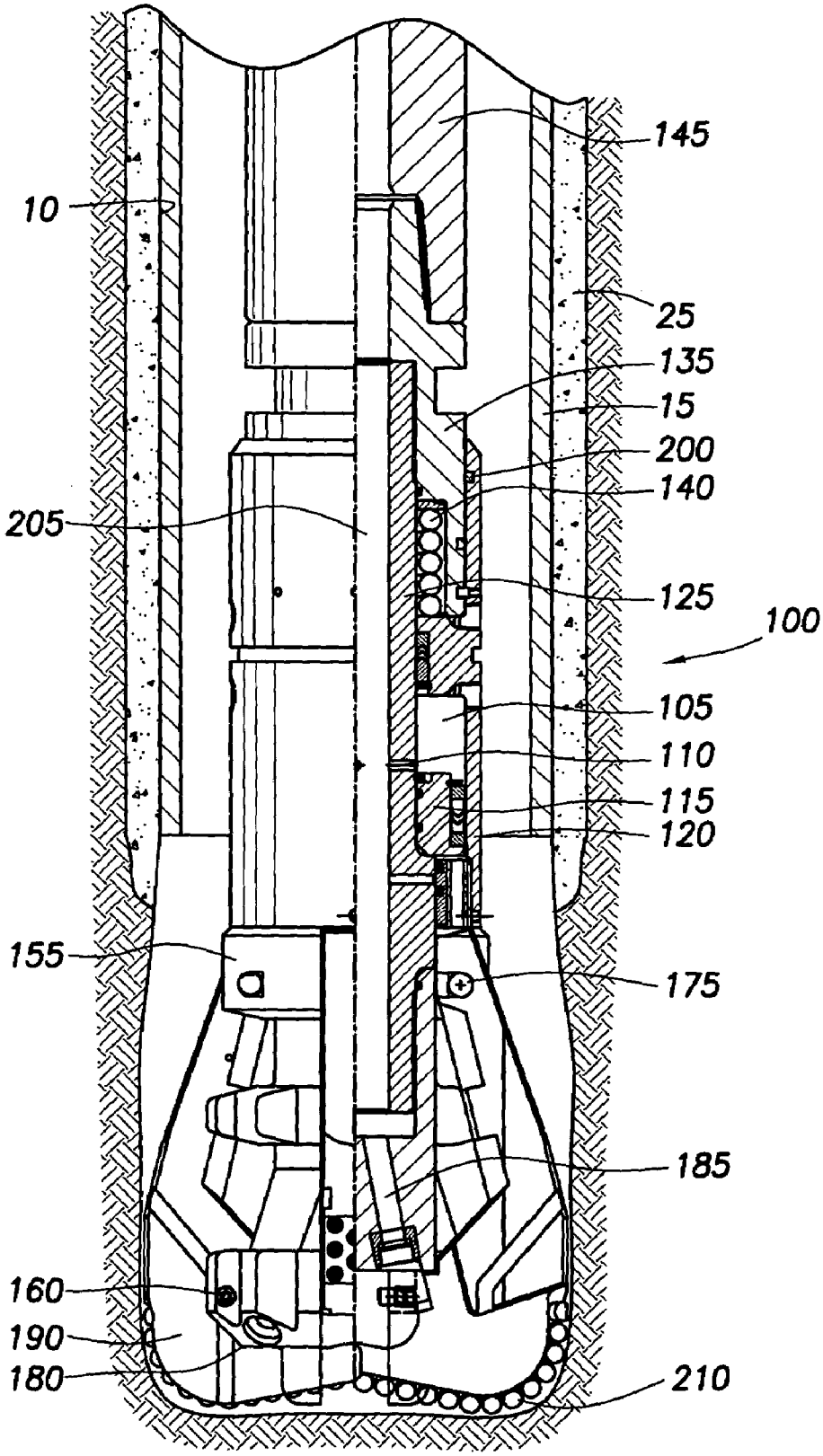
FIG. 4 is a sectional view illustrating the expandable bit forming a lower portion of a wellbore.

FIG. 4 is a sectional view illustrating the expandable bit 100 forming a lower portion of the wellbore 10. After the expandable bit 100 is placed at a desired location in the wellbore 10, the arms 190 are moved from the collapsed position and the expanded position by pumping fluid through the expandable bit 100. Thereafter, the drill string 145 and the expandable bit 100 are rotated and urged axially downward to form the lower portion of the wellbore 10.

After the expandable bit 100 has drilled the wellbore 10 to a designated depth, the arms 190 are moved from the expanded position to the collapsed position by reducing the fluid flow through the expandable bit 100. Generally, the reduction of fluid flow reduces the pressure differential created by the nozzles 185, thereby causing the fluid pressure in the chamber 105 to be reduced to a hydrodynamic pressure below that required to compress the biasing member 140. In other words, the reduction of the fluid flow allows the biasing member 140 to expand and urge the hydraulic cylinder 120 and the blade pivot housing 155 axially downward pushing the arms 190 over the head 180 and into the collapsed position. Thereafter, the expandable bit 100 may be removed from the wellbore 10 by pulling the drill string 145 and the bit 100 axially upward.

In operation, the expandable bit is attached to a lower end of a drill string. Thereafter, the drill string and expandable bit are placed at a desired location in the wellbore proximate the cementing system. Next, the expandable bit and the drill string are rotated and urged axially downward through the cementing system to a location proximate the lower end of the casing. Subsequently, the release member is actuated and the arms are extended by pumping fluid from the surface of the wellbore through the expandable bit. As fluid is pumped through the expandable bit, the nozzles restrict the fluid flow causing a hydraulic pressure differential and urging a portion of fluid through a port formed in the body to fill a chamber defined between the hydraulic cylinder and an internal piston. As the chamber fills with fluid, a hydraulic pressure force is created in the chamber that urges the hydraulic cylinder axially upward against the pressure release member. At a predetermined hydraulic pressure, the release member fails, thereby allowing the hydraulic cylinder to move in relation to the housing. As the chamber fills with additional fluid, the volume of the chamber increases, causing the hydraulic cylinder to move axially upward compressing a biasing member. At the same time, the hydraulic cylinder draws the blade pivot housing axially upward, thereby pulling the arms over the head and into the expanded position. Thereafter, the drill string and the expandable bit are urged axially downward to form the lower portion of the wellbore.

After the expandable bit has formed the wellbore to a designated depth, the expandable bit is typically closed hydraulically by reducing the fluid flow through the expandable bit. The reduction of the fluid flow allows the biasing member to expand and urge the hydraulic cylinder and the blade pivot housing axially downward pushing the arms over the head and into the collapsed position. Thereafter, the expandable bit may be removed from the wellbore by pulling the drill string and the expandable bit axially upward.

While the foregoing is directed to embodiments of the present invention, other and further embodiments of the invention may be devised without departing from the basic scope thereof, and the scope thereof is determined by the claims that follow.

The invention claimed is:

1. An expandable apparatus for use in a wellbore, comprising:

a body having a top portion and a bottom portion;

a blade assembly disposed on the bottom portion of the body, the blade assembly movable between a closed position whereby the expandable apparatus has a smaller outer diameter and an open position whereby the expandable apparatus has a larger outer diameter; and a hydraulic cylinder disposed around the body, the hydraulic cylinder movable between a first position and a second position, wherein the first position, the hydraulic cylinder is spaced apart from the bottom portion of the body at a first axial distance and in the second position the hydraulic cylinder is spaced apart from the bottom portion of the body at a larger second axial distance;

a fluid pressure activated member disposed between the hydraulic cylinder and the body, the fluid pressure activated member configured to selectively allow the blade assembly to move from the closed position to the open position as the hydraulic cylinder moves from the first position to the second position.

2. The expandable apparatus of claim 1, wherein the fluid pressure activated member comprises a least one shear pin connecting the body to the blade assembly.

3. The expandable apparatus of claim 2, wherein a predetermined axial force causes the at least one shear pin to fail allowing the blade assembly to move from the closed position to the open position.

4. The expandable apparatus of claim 1, wherein the fluid pressure activated member comprises a shearable connection between the body and the blade assembly.

5. The expandable apparatus of claim 4, wherein the shearable connection is formed by engaging a connection means on the body with a mating connection means on the blade assembly.

6. The expandable apparatus of claim 5, wherein the connection means and the mating connection means are constructed and arranged from at least one thread.

7. A method of forming a wellbore, comprising:

drilling a column of cement in a tubular with an expandable apparatus;

positioning the expandable apparatus proximate a lower end of the tubular;

applying an upward axial force to shift the expandable apparatus from a closed position to an open position; and forming a portion of the wellbore.

8. The method of claim 7, further including applying an upward axial force to activate a pressure activated member configured to selectively allow the expandable apparatus to move from the closed position to the open position.

9. The method of claim 8, wherein the pressure activated member is a shear pin disposed between a body and a cutting assembly of the expandable apparatus.

10. The method of claim 9, wherein a predetermined axial force shears the shear pin to allow the expandable apparatus to shift from the closed position to the open position.

11. The method of claim 8, wherein the pressure activated member disposed between a body and a cutting assembly of the expandable apparatus.

12. The method of claim 11, wherein the shearable connection is formed by engaging a connection means on the body with a mating connection means on the cutting assembly.

13. The method of claim 12, wherein the connection means and the mating connection means are constructed and arranged from at least one thread.

14. The method of claim 8, further including pumping fluid through the expandable assembly.

15. The method of claim 10, further including creating a pressure differential in a bore of the expandable apparatus to open the expandable apparatus.

16. An expandable bit for use in a wellbore, comprising:

a body;

at least one cutting member disposed on the body, the at least one cutting member movable between a collapsed position and an expanded position; and a release member disposed between the at least one cutting member and the body, the release member configured to selectively allow the at least one cutting member to move from the collapsed position to the expanded position upon application of an upwardly directed axial force on the release member.

17. The expendable bit of claim 16, wherein the release member comprises a shear pin connecting the body to the at least one cutting member.

18. The expandable bit of claim 16, wherein the release member comprises a shearable connection.

19. The expandable bit of claim 18, wherein the shearable connection is formed by engaging a connection means on the body with a mating connection means on the at least one cutting member.

20. A method of forming a wellbore, comprising:

positioning an expandable cutting apparatus in the wellbore;

applying an upward axial force to shear a shearable connection and to shift the expandable apparatus from a closed position to an open position; and rotating the expandable apparatus to form a portion of the wellbore.

21. The method of claim 20, further including rotating the expandable apparatus to drill through a cement system.

* * * * *

UNITED STATES PATENT AND TRADEMARK OFFICE

CERTIFICATE OF CORRECTION

PATENT NO. : 7,131,504 B2
APPLICATION NO. : 10/935485
DATED : November 7, 2006
INVENTOR(S) : Albert C. Odell, II et al.

It is certified that error appears in the above-identified patent and that said Letters Patent is hereby corrected as shown below:

In the Claims section:

In column 8, Claim 14, line 40, after "claim", please delete "8" and insert --7--.

Signed and Sealed this

Fifteenth Day of May, 2007

JON W. DUDAS
*Director of the United States Patent and Trademark Office*